US011326293B2

(12) United States Patent
Jeong

(10) Patent No.: US 11,326,293 B2
(45) Date of Patent: May 10, 2022

(54) LEVEL ADJUSTABLE APPARATUS AND METHOD FOR ADJUSTING LEVEL THEREOF

(71) Applicant: LG ELECTRONICS INC., Seoul (KR)

(72) Inventor: Jae Yoon Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 137 days.

(21) Appl. No.: 16/561,619

(22) Filed: Sep. 5, 2019

(65) Prior Publication Data

US 2019/0390390 A1 Dec. 26, 2019

(30) Foreign Application Priority Data

May 8, 2019 (WO) ..... PCT/KR2019/005483

(51) Int. Cl.
*D06F 33/48* (2020.01)
*D06F 39/12* (2006.01)
(Continued)

(52) U.S. Cl.
CPC ..... *D06F 33/48* (2020.02); *D06F 39/125* (2013.01); *D06F 34/14* (2020.02); *D06F 34/16* (2020.02); *D06F 34/20* (2020.02); *D06F 2103/00* (2020.02); *D06F 2103/26* (2020.02); *D06F 2105/00* (2020.02); *D06F 2105/58* (2020.02)

(58) Field of Classification Search
None
See application file for complete search history.

(56) References Cited

FOREIGN PATENT DOCUMENTS

JP 2009-247782 A 10/2009
JP 2018-175391 A 11/2018
(Continued)

OTHER PUBLICATIONS

English Machine Translation of JP-2018175391-A.*
English Machine Translation of KR-20080078769-A.*

*Primary Examiner* — Mikhail Kornakov
*Assistant Examiner* — Pradhuman Parihar
(74) *Attorney, Agent, or Firm* — Birch, Stewart, Kolasch & Birch, LLP

(57) ABSTRACT

The present disclosure relates to a level adjustable washing machine and a method for adjusting a level of the washing machine. According to an embodiment of the present disclosure, the level adjustable washing machine may include a cabinet forming an exterior of the washing machine; a tub disposed in the cabinet; a drum rotatably disposed inside the tub and configured to receive laundry; a level sensor disposed on at least one surface of the cabinet and configured to sense a tilt of the cabinet; a vibration sensor disposed on at least one side of the tub and configured to sense vibration generated by rotation of the drum; a plurality of height adjustable supports disposed on a bottom portion of the cabinet; and a processor configured to receive tilt information of the cabinet from the level sensor, receive information on the vibration generated by rotation of the drum from the vibration sensor, and derive a tilt value of the cabinet that is capable of minimizing the vibration of the corresponding washing machine using an artificial intelligence pre-trained through machine learning.

6 Claims, 10 Drawing Sheets

(51) Int. Cl.

| | |
|---|---|
| ***D06F 34/14*** | (2020.01) |
| ***D06F 34/16*** | (2020.01) |
| ***D06F 34/20*** | (2020.01) |
| *D06F 103/00* | (2020.01) |
| *D06F 103/26* | (2020.01) |
| *D06F 105/00* | (2020.01) |
| *D06F 105/58* | (2020.01) |

(56) References Cited

FOREIGN PATENT DOCUMENTS

| | | | | |
|---|---|---|---|---|
| JP | 2018175391 | A | * | 11/2018 |
| KR | 10-0505226 | B1 | | 8/2005 |
| KR | 10-2008-0032360 | A | | 4/2008 |
| KR | 10-2008-0078769 | A | | 8/2008 |
| KR | 20080078769 | A | * | 8/2008 |
| KR | 10-2010-0070856 | A | | 6/2010 |
| KR | 10-2013-0070808 | A | | 6/2013 |
| KR | 10-2017-0114600 | A | | 10/2017 |
| WO | WO 2012/089498 | A2 | | 7/2012 |

* cited by examiner

LEVEL ADJUSTABLE APPARATUS AND METHOD FOR ADJUSTING LEVEL THEREOF

CROSS-REFERENCE TO RELATED APPLICATION

This present application claims benefit of priority to PCT Patent Application No. PCT/KR2019/005483, entitled "LEVEL ADJUSTABLE APPARATUS AND METHOD FOR ADJUSTING LEVEL THEREOF" and filed on May 8, 2019, in the World Intellectual Property Organization, the entire disclosure of which is incorporated herein by reference.

TECHNICAL FIELD

The present disclosure relates to a level adjustable apparatus and a method for adjusting a level of the apparatus. More particularly, the present disclosure relates to, in an apparatus having a rotating member, such as a washing machine, a method for adjusting a level of the apparatus to minimize vibration of the apparatus, using a level sensor configured to sense a tilt of the apparatus, a vibration sensor configured to sense the vibration of the apparatus, and a plurality of height adjustable supports configured to adjust the level of the apparatus. Also, the present disclosure relates to an apparatus to which the method is applied.

BACKGROUND ART

The following description is only for the purpose of providing background information related to embodiments of the present disclosure, and the contents to be described do not necessarily constitute related art.

An apparatus having a rotating member is caused to vibrate by rotation of the member. Specifically, when the apparatus is tilted in a certain direction, a vibration magnitude of the entire apparatus may increase due to rotation of the rotating member, which may generate noise, damage a part of the apparatus, cause the apparatus to deviate from the originally installed position, and degrade energy efficiency.

Examples of apparatuses having a rotating member that may cause such phenomena may include, but are not limited to, a washing machine, a dryer, and an automatic dishwasher. Among these examples, the above-mentioned phenomena typically occur in the washing machine.

When the washing machine is not correctly leveled at the initial installation, or when the washing machine is initially leveled but is tilted or moved and becomes out of level due to operations of the washing machine during use of the washing machine, the vibration of the washing machine may be increased due to a rotation operation of a drum in the washing machine, which may generate noise, damage the washing machine, and degrade washing efficiency.

Therefore, there have been many attempts to reduce the vibration generated by rotation of the rotating member, especially in the washing machine.

Korean Patent Registration No. 10-505226, entitled "Washer," discloses a washing machine including a tub which receives water or detergent, a drum rotatably disposed inside the tub and configured to rotate by driving of a motor, a sensing sensor configured to sense excessive vibration of the tub, and a control unit configured to turn off the driving of the motor when the vibration of the tub is excessive.

That is, in the above-mentioned patent document, when a vibration magnitude increases, the motor is turned off to stop the operation of the washing machine, thereby preventing the washing machine from being damaged or moving from its original position. However, in the above-mentioned configuration, the operation of the washing machine is stopped each time the vibration increases. Also, the above-mentioned configuration does not provide a fundamental solution to the cause of excessive vibration of the washing machine.

In another example, Korean Patent Application Publication No. 10-2008-0032360, entitled "Washing machine comprising fixing apparatus," discloses a washing machine including a fixing apparatus configured to be leveled to reduce vibration of the washing machine and formed separately from the washing machine, wherein the fixing apparatus includes a supporting stand and a plurality of regulating legs configured to adjust a height of the supporting stand, so that the leveling of the washing machine can be easily adjusted.

However, the above-mentioned configuration does not guide a user as to what state the level of the washing machine is in, and as to how much the height of the supporting stand should be adjusted for an appropriate leveling state, to reduce the vibration. Thus, in order to reduce the vibration, the user needs to adjust the height of the supporting stand using his or her own judgment. Also, in the above-mentioned configuration, a separate fixing apparatus is required, in addition to the washing machine, to reduce the vibration.

As another example, Korean Patent Application Publication No. 10-2017-0114600, entitled "Washing machine," discloses a method for attenuating vibration and noise generated in a washing machine, using a damper configured to buffer vibration of a tub, a friction member configured to restrict movement of a vibration transferring bar, and a vibration adjustment member configured to press the friction member.

However, in the above-mentioned configuration, when the level state of the washing machine is outside of a certain range, vibration is still increased. Also, the above-mentioned configuration does not provide a method for adjusting a tilt of the washing machine in an optimal state for operating the washing machine.

As still another example, Korean Patent Application Publication No. 10-2013-0070808, entitled "Apparatus and method for controlling horizontal position of washing machine," discloses an apparatus for adjusting a level of a washing machine including a tilt measurement unit configured to measure a tilt of the washing machine relative to a floor surface, a height adjustment unit configured to adjust a height of the washing machine, and a control unit configured to control the height adjustment unit according to a level state and adjust the height of the washing machine to a level state.

However, the above-mentioned configuration only discloses an idea of adjusting the level of the washing machine by adjusting the height of the washing machine, and does not provide a specific method as to how much the height of the washing machine should be adjusted. In addition, the above-mentioned configuration discloses merely the method for adjusting the level, and does not provide a method for directly reducing vibration.

Accordingly, there is a need for a method for re-adjusting the level of the washing machine, even after the level is initially adjusted. Further, beyond the idea of simply adjusting the height of the washing machine to adjust the level, there is a need to provide a method for specifically determining the height of the washing machine to be adjusted, and ultimately reducing the vibration, rather than simply adjusting the level.

DISCLOSURE OF INVENTION

Technical Problem

The present disclosure provides an apparatus having a rotating member that is capable of preventing an excessive increase in vibration generated by rotation of the rotating member, when the apparatus is tilted out of level or when the weight of an object received in the apparatus is unevenly distributed.

Furthermore, the present disclosure provides a method and an apparatus that is capable of adjusting the level and reducing vibration of the apparatus, in order to solve the shortcomings in which vibration is generated in the apparatus due to rotation of the rotating member, which generates noise, damages a part of the apparatus, and degrades washing efficiency.

In addition, the present disclosure provides a method, and an apparatus for performing the method, for solving the shortcomings in which after a level of the apparatus is initially adjusted, the level is difficult to re-adjust, and in which a user does not know precisely a specific tilt value or height adjustment value of the washing machine, which is a target adjustment value for minimizing vibration.

In addition, the present disclosure provides an individually adapted leveling method and an apparatus for performing the method, in order to solve the shortcoming in which, since each apparatus having a rotating member has different characteristics and the environment in which each apparatus is installed is different, a tilt value or a height adjustment value for minimizing the vibration is different.

In addition, the present disclosure provides a tilt adjustment method for minimizing vibration and an apparatus for performing the method, in order to solve the shortcoming associated with methods which are aimed at merely adjusting a level, considering the fact that vibration may be generated not only by the apparatus itself not being level with the floor but also by other causes.

In addition, the present disclosure provides a method for detecting a tilt value that is capable of minimizing vibration more precisely when vibration above a certain magnitude is generated even though a tilt of the apparatus has been initially adjusted to reduce the vibration.

In addition, the present disclosure provides a method and an apparatus for transmitting information on a target tilt value and a height to be adjusted to a user, in order to solve the shortcoming in which when a tilt is adjusted to reduce the vibration of the apparatus, the user does not know exact information on the targeted tilt value and the height adjustment value for achieving the targeted tilt value.

In addition, the present disclosure provides a method and an apparatus for accurately and quickly providing a tilt value of the apparatus that is capable of minimizing vibration, in order to solve the shortcomings in which a method for determining a specific tilt value that may reduce the vibration of the apparatus is not known, and in which it takes a long time to determine the tilt value.

Solution to Problem

The present disclosure discloses a configuration that allows level adjustment in an apparatus having a rotating member, so that even after a level of the apparatus has been initially adjusted, a tilt of the apparatus may be easily adjusted to minimize vibration when the vibration is generated.

According to one embodiment of the present disclosure, a level adjustable apparatus includes a level sensor configured to sense a tilt of the apparatus, a vibration sensor configured to sense vibration of the apparatus, and a plurality of height adjustable supports configured to support the apparatus, wherein a processor of the apparatus is configured to derive a tilt value that is capable of minimizing the vibration when a vibration magnitude sensed by means of the vibration sensor exceeds a threshold.

In addition, the derived tilt value that is capable of minimizing the vibration may be transmitted to a user terminal, allowing a user to adjust heights of the supports to achieve a target tilt value. Also, the heights of the height adjustable supports may be automatically adjusted in order to achieve the derived tilt value that is capable of minimizing the vibration.

Here, the heights of the supports may be adjusted in a motorized manner by a controller embedded in the apparatus, wherein each support may be independently controlled.

According to this embodiment of the present disclosure, the level adjustable apparatus may determine the tilt value that is capable of minimizing the vibration, based on a model previously learned in a leveling learning mode.

In the leveling learning mode, the apparatus may sense the vibration generated while adjusting the tilt of the apparatus, under various conditions for at least one of a rotational speed of the rotating member and the weight of an object received in the rotating member, and then learn the tilt value of the apparatus that is capable of minimizing the vibration in each of the conditions.

According to this embodiment of the present disclosure, the level adjustable apparatus may include a cabinet having a front portion, a rear portion, side portions, a top portion, and a bottom portion forming an exterior of the apparatus; a rotating member disposed in the cabinet; a level sensor configured to sense a tilt of the cabinet; a vibration sensor configured to sense the vibration generated by rotation of the rotating member; and a plurality of height adjustable supports disposed on the bottom portion of the cabinet.

According to this embodiment of the present disclosure, the level adjustable apparatus may further include a memory in which information for leveling the cabinet is stored; and a processor configured to receive tilt information of the cabinet from a level sensor and derive a tilt value of the cabinet that is capable of minimizing the vibration, based on the information for leveling stored in the memory.

The information for leveling stored in the memory may be based on the model previously learned in the leveling learning mode. In the leveling learning mode, the apparatus may sense the vibration generated while adjusting the tilt of the apparatus, under various conditions for at least one of a rotational speed of the rotating member and the weight of an object received in the rotating member, and then learn the tilt value of the apparatus that is capable of minimizing the vibration in each of the conditions.

According to this embodiment of the present disclosure, the level adjustable apparatus may further include a communication unit configured to communicate with a user terminal. The communication unit may transmit, to the user terminal, heights of the supports to be adjusted in order to achieve the tilt value of the cabinet that is derived from the processor and is capable of minimizing the vibration.

In addition, according to this embodiment of the present disclosure, the level adjustable apparatus may further include a controller configured to adjust the heights of the supports in a motorized manner. The controller may adjust the heights of the supports in order to achieve the tilt value of the cabinet that is derived from the processor and is capable of minimizing the vibration.

According to another embodiment of the present disclosure, a level adjustable washing machine may include a cabinet forming an exterior of a washing machine; a tub disposed in the cabinet; a drum rotatably disposed inside the tub and configured to receive laundry; a level sensor disposed on at least one side of the cabinet and configured to sense a tilt of the cabinet; a vibration sensor disposed on at least one surface of the tub and configured to sense vibration generated by rotation of the drum; and a plurality of height adjustable supports disposed on a bottom portion of the cabinet.

According to this embodiment of the present disclosure, the washing machine may further include a processor, configured to: receive tilt information of the cabinet from the level sensor; receive information on the vibration generated by rotation of the drum from the vibration sensor; and derive a tilt value of the cabinet that is capable of minimizing the vibration.

In addition, according to this embodiment of the present disclosure, the washing machine may further include a memory in which information for leveling the cabinet is stored. The information for leveling may be information which is learned in a leveling learning mode of the washing machine by sensing the vibration generated while adjusting the tilt of the cabinet, under various conditions for at least one of a rotational speed of the drum and a weight of laundry received in the drum, and may be information on the tilt value of the cabinet that is capable of minimizing the vibration in each of the conditions.

Here, the processor may be configured to derive the tilt value of the cabinet that is capable of minimizing the vibration, based on the information for leveling the cabinet.

In addition, according to this embodiment of the present disclosure, the washing machine may further include a communication unit configured to communicate with a user terminal. The communication unit may transmit, to the user terminal, heights of the supports to be adjusted in order to achieve the tilt value of the cabinet that is derived from the processor and is capable of minimizing the vibration.

In addition, according to this embodiment of the present disclosure, the washing machine may further include a controller configured to adjust the heights of the supports. The controller may adjust the heights of the supports in order to achieve the tilt value of the cabinet that is derived from the processor and is capable of minimizing the vibration.

Here, after the heights of the supports are adjusted in order to achieve the tilt value of the cabinet, the processor may receive vibration information from the vibration sensor and search for an optimum tilt value that minimizes a vibration magnitude, while causing the controller to vary the tilt of the cabinet within a certain range from the achieved tilt value, and may cause the controller to re-adjust the heights of the supports to achieve the optimal tilt value.

In addition, according to this embodiment of the present disclosure, the level sensor of the washing machine is attached to the center of the top portion of the cabinet, and the tilt may have a roll angle, a pitch angle, and yaw angle.

In addition, according to this embodiment of the present disclosure, the vibration sensor of the washing machine may be disposed at a location of one surface of the tub which is capable of sensing the vibration in a direction perpendicular to the rotation axis of the drum.

In addition, according to this embodiment of the present disclosure, the processor of the washing machine may derive the tilt value of the cabinet that is capable of minimizing vibration when the vibration magnitude received by the vibration sensor exceeds a certain magnitude, or after an operation mode of the washing machine is switched to a spin-dry mode.

According to still another embodiment of the present disclosure, a method for adjusting a level of a washing machine may include: in a leveling learning mode of the washing machine, sensing and analyzing vibration generated while adjusting a tilt of the washing machine, under various conditions for at least one of a rotational speed of a drum disposed in the washing machine and a weight of laundry received in the drum; and obtaining information on a tilt value of the washing machine that is capable of minimizing the vibration, in each of the conditions in the sensing and analyzing; and storing the obtained information as leveling information of the washing machine.

Thereafter, the method for adjusting the level of the washing machine may further include: in a normal use mode of the washing machine, sensing vibration of the washing machine, by means of a vibration sensor disposed in the washing machine; and deriving, by means of the processor of the washing machine, a target tilt value of the washing machine that is capable of minimizing the vibration, based on the leveling information, when the vibration magnitude exceeds a predetermined threshold or after the washing machine enters a spin-dry operation.

According to this embodiment of the present disclosure, a plurality of a height adjustable supports may be disposed on a bottom surface of the washing machine, and the method for adjusting the level of the washing machine may further include: after the deriving of the target tilt value, transmitting, by means of a communication unit disposed in the washing machine, heights of supports to be adjusted in order to achieve the tilt value of the washing machine that is capable of minimizing the vibration, to a user terminal.

According to this embodiment of the present disclosure, the method for adjusting the level of the washing machine may further include: after the transmitting, measuring a vibration value and determining whether the vibration value is less than or equal to a predetermined threshold, by means of the vibration sensor, when the tilt value of the washing machine is achieved; and re-deriving, by the processor of the washing machine, the tilt value of the washing machine that is capable of minimizing the vibration value, based on the leveling information, when the vibration value exceeds the predetermined threshold.

According to this embodiment of the present disclosure, a plurality of the height adjustable supports may be disposed on a bottom portion of the washing machine, the washing machine may include a controller configured to adjust the heights of the supports, and the method for adjusting the level of the washing machine may further include: after the deriving the target tilt value, adjusting, by means of controller, the heights of the supports to achieve the tilt value of the cabinet that is capable of minimizing the vibration.

According to this embodiment of the present disclosure, the method for adjusting the level of the washing machine may further include: after the adjusting the heights of the supports, receiving vibration information from the vibration sensor and searching for an optimum tilt value that minimizes a vibration magnitude, by means of the controller, while varying a tilt of the cabinet within a certain range from the achieved tilt value in the adjusting the heights of the supports; and re-adjusting, by the controller, the heights of the supports to achieve the searched optimal tilt value.

According to this embodiment of the present disclosure, the method for adjusting the level of the washing machine may further include: after the re-adjusting, updating the leveling information using the searched optimal tilt value.

According to yet another embodiment of the present disclosure, provided is a method for adjusting a level of an apparatus having a rotating member, wherein the apparatus may include a cabinet having a front portion, a rear portion, side portions, a top portion, and a bottom portion to form an exterior of the apparatus; a rotating member disposed in the cabinet; a level sensor configured to sense a tilt of the cabinet; a vibration sensor configured to sense vibration generated by rotation of the rotating member; a plurality of height adjustable supports disposed on the bottom portion of the cabinet; and a processor configured to communicate with the level sensor and the vibration sensor.

According to this embodiment of the present disclosure, the method for adjusting the level of the apparatus having the rotating member may include: sensing, by means of the vibration sensor, the vibration generated by rotation of the member; and deriving, by means of the processor, a target tilt value of the cabinet that is capable of minimizing the vibration, based on previously learned leveling information, when the vibration magnitude exceeds a predetermined threshold.

According to this embodiment of the present disclosure, in the method for adjusting the level of the apparatus having the rotating member, the previously learned leveling information may be information which is learned in a leveling learning mode of the apparatus by sensing the vibration generated while adjusting the tilt of the cabinet, under various conditions for at least one of a rotational speed of the rotating member and the weight of an object received in the rotating member, and may be information on a tilt value of the cabinet that is capable of minimizing the vibration in each of the conditions.

Advantageous Effects of Invention

According to embodiments of the present disclosure, it is possible to provide an apparatus and a method for solving the shortcoming in which when an apparatus having a rotating member is tilted out of level, or the weight of an object received in the apparatus is unevenly distributed, vibration generated by rotation of the rotating member excessively increases.

In addition, according to embodiments of the present disclosure, it is possible to provide a level adjustable apparatus and a method for adjusting a level of the apparatus that is capable of minimizing vibration generated in the apparatus by rotation of a rotating member, thereby reducing noise generated from the apparatus.

In addition, according to embodiments of the present disclosure, it is possible to provide a level adjustable apparatus and a method for adjusting a level of the apparatus that is capable of minimizing transfer of a force caused by a rotation operation of a rotating member to other parts of the apparatus, thereby maximizing energy efficiency of the apparatus.

In addition, according to embodiments of the present disclosure, it is possible to provide a level adjustable apparatus and a method for adjusting a level of the apparatus that is capable of minimizing vibration generated in the apparatus by rotation of a rotating member, thereby preventing damage to the apparatus that may be caused by the vibration.

In addition, according to embodiments of the present disclosure, it is possible to solve the shortcoming in which is difficult to re-adjust a level of an apparatus after the level is initially adjusted, and to provide a user with a specific tilt or height adjustment value of the apparatus, which is a target adjustment value for minimizing vibration.

In addition, according to embodiments of the present disclosure, it is possible to automatically adjust a plurality of the height adjustable supports disposed on a bottom portion of an apparatus, so as to achieve a targeted specific tilt value or height adjustment value of the apparatus.

In addition, according to embodiments of the present disclosure, it is possible to provide a method for adjusting a level and an apparatus for performing the method that is capable of individually adapting a tilt value or a height adjustment value of each apparatus having a rotating member, considering that each apparatus having a rotating member has different characteristics and the environment in which each apparatus is installed is different, and the tilt value or the height adjustment value for minimizing vibration is thus different.

In addition, according to embodiments of the present disclosure, it is possible to provide a tilt adjustment method and an apparatus for performing the method that is capable of minimizing vibration, rather than merely aiming at level adjustment, since a cause of the vibration is not only that the apparatus itself is not level with a floor, but also that the vibration may be generated due to other causes.

In addition, according to embodiments of the present disclosure, it is possible to provide a method for again more precisely detecting a tilt value that is capable of minimizing vibration when vibration above a certain magnitude is still generated even though a tilt of an apparatus has been initially adjusted to reduce the vibration.

In addition, according to embodiments of the present disclosure, it is possible to provide accurately and quickly a tilt value of an apparatus that is capable of minimizing vibration, in order to solve the shortcomings in which a method for determining a specific tilt value that may reduce the vibration of an apparatus is not known, and that it takes a long time to determine the tilt value.

DESCRIPTION OF EMBODIMENTS

Figure 1:
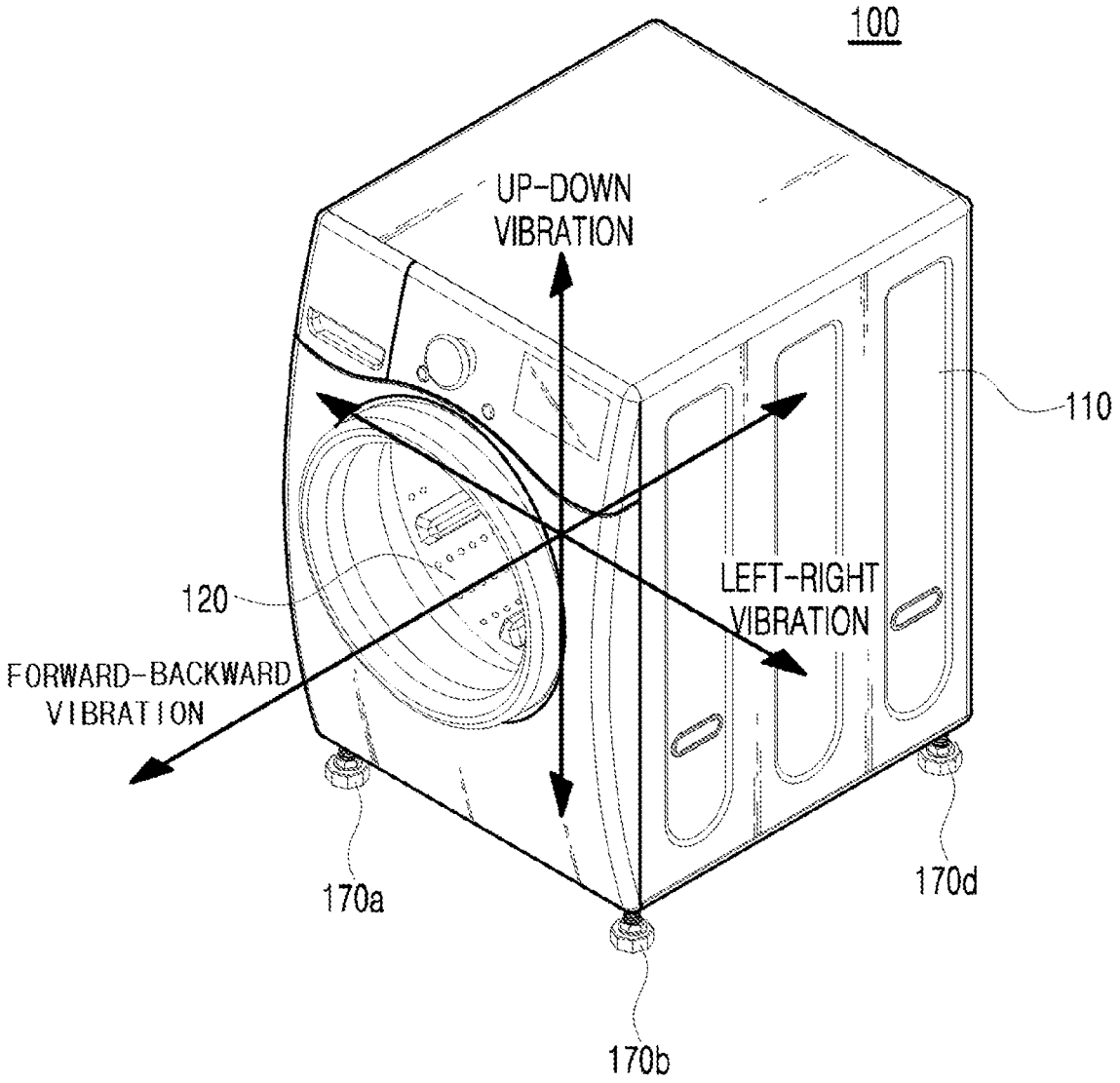
FIG. 1 is a view illustrating vibration that may be generated in a washing machine according to an embodiment of the present disclosure.

Hereinafter the embodiments disclosed in this specification will be described in detail with reference to the accompanying drawings. The present disclosure may be embodied in various different forms and is not limited to the embodiments set forth herein. Hereinafter in order to clearly describe the present disclose, parts that are not directly related to the description are omitted. However, in implementing an apparatus or a system to which the spirit of the present disclosure is applied, it is not meant that such an omitted configuration is unnecessary. In addition, the like reference numerals are used for the like or similar components throughout the specification.

In the following description, terms such as "the first," "the second," and the like may be used in describing various components, but the above components shall not be restricted to the above terms. The terms are only used to distinguish one component from the other. Also, in the following description, the articles "a," "an," and "the," include plural referents unless the context clearly dictates otherwise.

In the following description, it will be understood that terms such as "comprise," "include," "have," and the like are intended to specify the presence of stated feature, integer, step, operation, component, part or combination thereof, but do not preclude the presence or addition of one or more other features, integers, steps, operations, components, parts or combinations thereof.

FIG. 1 is a view illustrating vibration that may be generated in a washing machine according to an embodiment of the present disclosure.

A washing machine 100 according to an embodiment of the present disclosure relates to a washing machine that may adjust a level even after initial installation. The level adjustable washing machine may include a cabinet 110 having a front portion, a rear portion, side portions, a top portion, and a bottom portion forming an exterior of the washing machine; a rotatable drum 120 configured to receive laundry; and a plurality of height adjustable supports 170*a*, 170*b*, 170*c*, and 170*d* disposed on the bottom portion of the cabinet 100.

Although not shown in FIG. 1, a tub configured to receive washing water may be disposed in the cabinet 110, and the rotatable drum 120 may be disposed in the tub.

The drum of the washing machine 100 may rotate at various speeds in a normal operating mode. When the washing machine 100 is out of level, or laundry received in the drum 120 becomes concentrated on one side and thus unevenly distributed, the vibration may be excessively generated.

Such vibration may cause noise, and degrade the customer's satisfaction in using the product. In addition, the vibration may cause damage to internal parts of the washing machine 100, thereby shortening the life of the washing machine 100.

In addition, the vibration may cause the rotational force of the drum 120 to be dispersed to other parts instead of being fully used for washing and drying, thereby deteriorating performance and energy efficiency of the washing machine 100.

The vibration generated in the washing machine 100 may occur in various directions, such as up-down vibration, left-right vibration, and forward-backward vibration, according to a tilted direction of the washing machine 100 or an uneven distribution of laundry received in the drum 120.

When the washing machine 10 is initially installed, the level is adjusted according to the experience of the installer, and the vibration may thus not be significantly generated initially. However, over time, the washing machine 100 may be moved or tilted, and the vibration may thus come to be generated every time the drum rotates.

Therefore, it is necessary to provide a means configured to re-adjust the level of the washing machine 100 while sensing the vibration generated in the washing machine 100, even after the initial installation.

In addition, the environment in which the washing machine 100 is installed may have a variety of conditions, such as a tilt, a degree of slipperiness the installation floor surface, and the like. Since various kinds of vibration may accordingly be generated, it may be difficult to eliminate or reduce the vibration generated during operation of the washing machine 100 by merely adjusting the level.

Accordingly, the embodiments of the present disclosure are capable of determining a tilt value of the washing machine 100 that is capable of minimizing the vibration, and individually adjusting the heights of the supports 170*a*, 170*b*, 170*c*, and 170*d* disposed on the bottom portion of the washing machine 100 so that the washing machine 100 may be leveled to the determined tilt value, rather than merely adjusting the level of the washing machine with respect to the floor surface.

Figure 2:
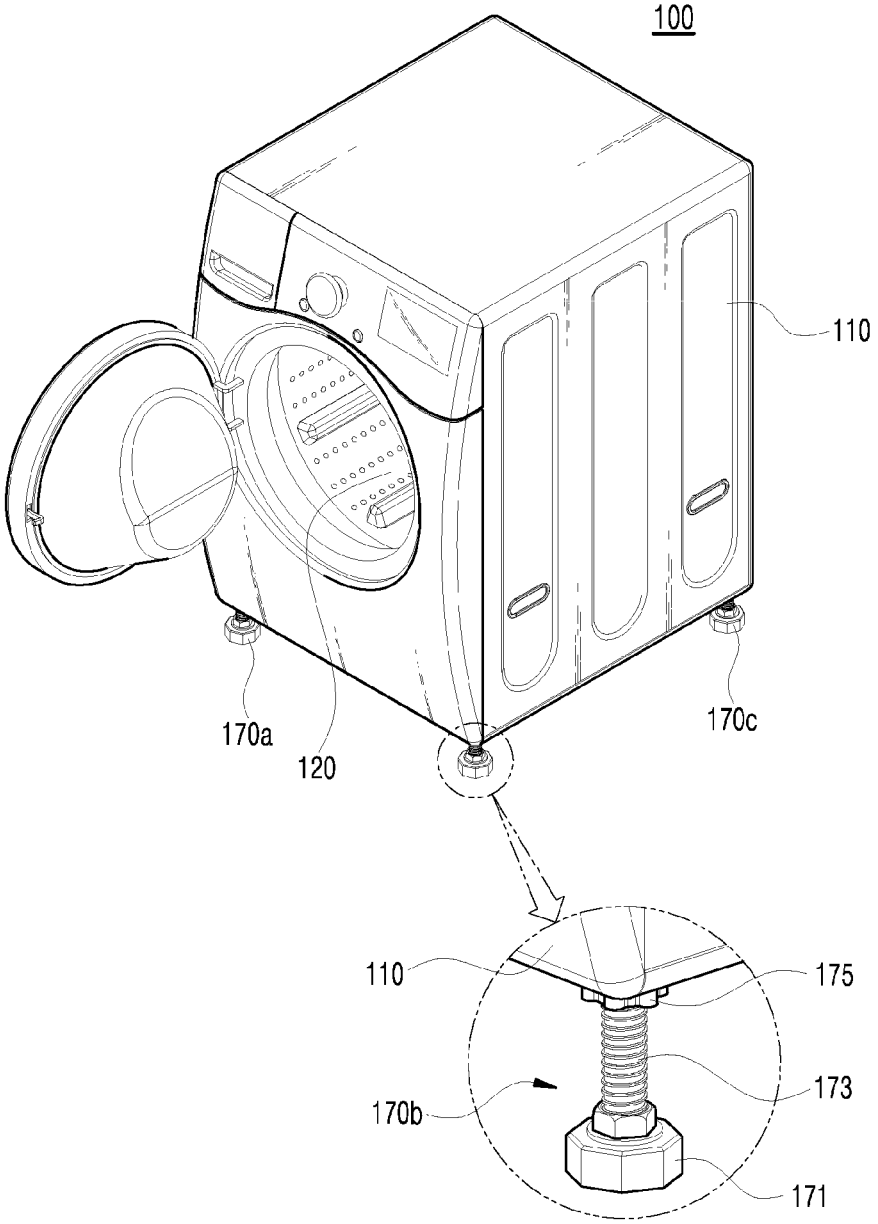
FIG. 2 illustrates a plurality of height adjustable supports disposed on a bottom portion of the washing machine according to an embodiment of the present disclosure.

FIG. 2 illustrates a plurality of height adjustable supports disposed on a bottom portion of the washing machine according to an embodiment of the present disclosure.

More specifically, with reference to a plurality of height adjustable supports 170*a*, 170*b*, 170*c*, and 170*d* disposed on the bottom portion of the washing machine 100, the support 170*b* may include a floor pedestal 171, a length adjustment portion 173, and a cabinet connection portion 175.

Here, when a user rotates the length adjustment portion 173 along a spiral of the length adjustment portion 173, the length adjustment portion 173 enters into the washing machine 100, thereby varying the height of the support 170*b*.

FIG. 2 illustrates that the supports are disposed at four corners on the bottom portion of the cabinet 110, but fewer or more supports may be disposed. In addition, the locations at which the supports are disposed may be freely configured according to the embodiments, as long as an angle of the washing machine 100 may be adjusted.

In the configuration of FIG. 2, the heights of the supports are not adjusted by the washing machine 100 itself. In this configuration, the heights of the supports to be adjusted, according to a tilt value to be achieved which is determined by a processor of the washing machine 100, is transmitted to a user terminal. Then, the user may check these values and manually adjust the heights of the supports, thereby achieving a desirable tilt of the washing machine 100.

Figure 3:
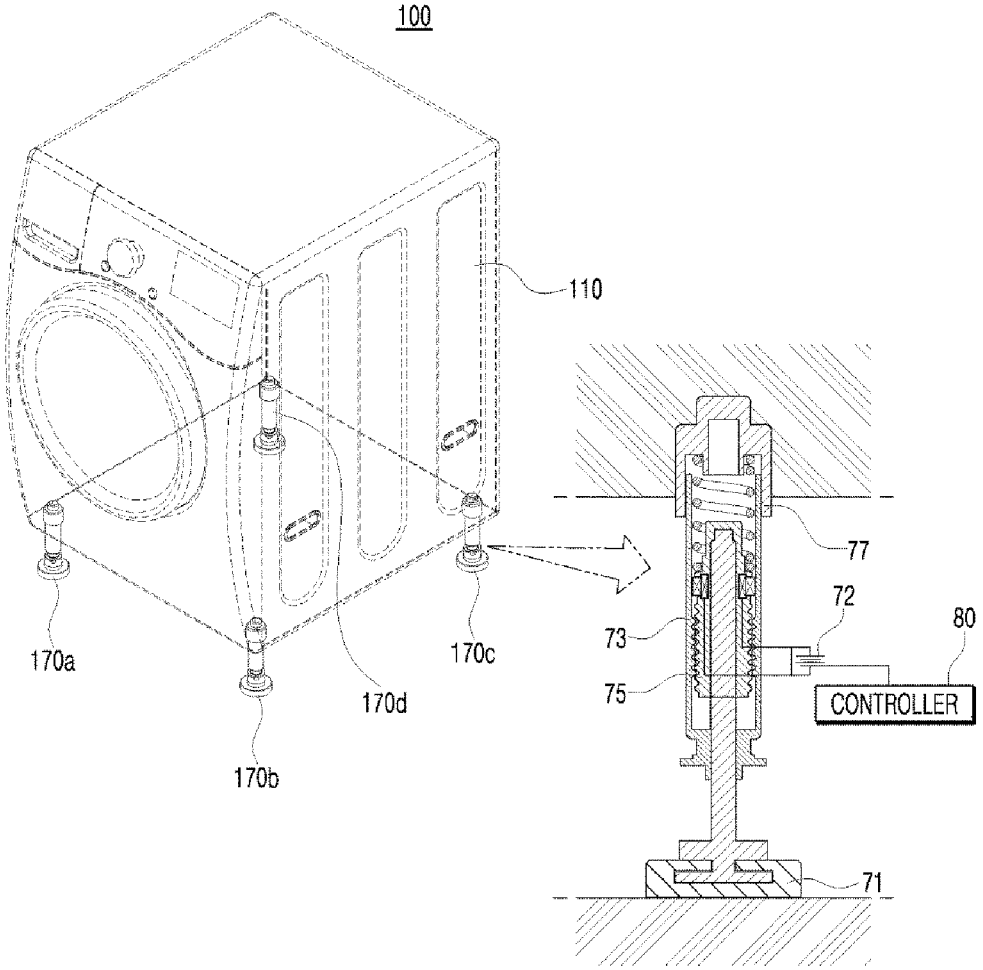
FIG. 3 illustrates a plurality of automatically height adjustable supports disposed on a bottom portion of a washing machine according to another embodiment of the present disclosure.

FIG. 3 illustrates a plurality of automatically height adjustable supports disposed on a bottom portion of a washing machine according to another embodiment of the present disclosure.

In FIG. 3, the supports 170*a*, 170*b*, 170*c*, and 170*d* disposed on the bottom portion of the cabinet 110 are configured to be adjustable in a motorized manner. Thus, each support may be adjusted such that the heights of the supports to be adjusted, according to a tilt value to be achieved which is determined by the processor of the washing machine 100, are realized.

More specifically, with reference to a height adjustable support 170*c*, the support 170*c* may include a floor support portion 71, an outer length adjustment portion 75, an inner length adjustment portion 77, and a cabinet connection portion 77, and may be connected to a power supply 72 and a controller 80. The power may be supplied through a power supply of the washing machine, rather than through a separate power source.

The controller 80 may adjust the operation of the inner length adjustment portion 75, so that the inner length adjustment portion 75 rotates clockwise or counterclockwise within the outer length adjustment portion 73, thereby allowing the inner length adjustment portion 75 to move up and down. The overall height of the supports 107*a*, 107*b*, 107*c*, and 107*d* may be adjusted by moving the inner length adjustment portion 75 up and down.

The controller 80 communicates with the processor of the washing machine 100, and is instructed how much to adjust the heights of the supports 107*a*, 107*b*, 107*c*, and 107*d*. The processor of the washing machine 100 analyzes a degree of tilting and a degree of vibration of the cabinet 110, and calculates a tilt value of the cabinet 110 that is capable of minimizing the vibration. The processor further computes the heights the supports 107*a*, 107*b*, 107*c*, and 107*d* to be adjusted for achieving the tilt value, and transmits the computed values to the controller 80.

Alternatively, the controller 80 may receive a tilt value from a level sensor configured to sense the tilt of the washing machine 100, and adjust the heights of the supports 107*a*, 107*b*, 107*c*, and 107*d* to level the washing machine 100.

Although FIG. 3 illustrates only four supports, the number of supports may be adjusted within a range in which the tilt of the washing machine 100 may be adjusted. Also, each of the supports 107*a*, 107*b*, 107*c*, and 107*d* may be independently adjusted.

Figure 4:
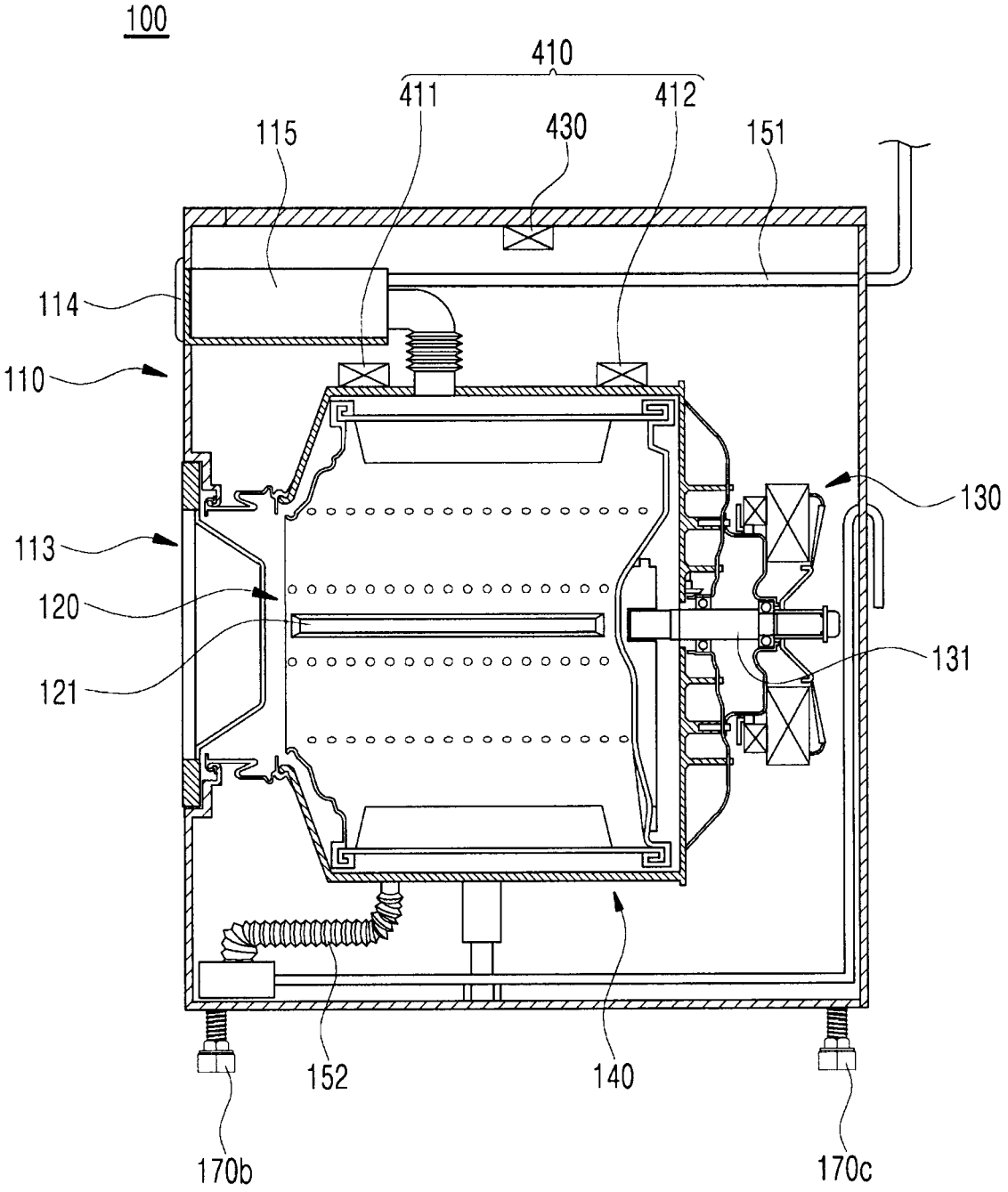
FIG. 4 illustrates a longitudinal sectional view of the washing machine according to an embodiment of the present disclosure.

FIG. 4 illustrates a longitudinal sectional view of the washing machine according to an embodiment of the present disclosure.

In the washing machine 100, a drum 120 configured to receive laundry, a motor 130 configured to rotate the drum, a tub 140 configured to receive washing water, a water supply pipe 151 configured to supply water to the tub 140, a drain pipe 152 configured to discharge water, and a detergent drawer 115 configured to dispense a detergent may be disposed.

In addition, on the washing machine 100, a door 113 configured to open and close the entrance to the drum may be disposed, and a control panel 114 may be disposed on the top the front portion of the cabinet 110. The control panel 114 may be provided with a plurality of buttons to manipulate operations of the washing machine 100, and may include a display 141 (shown in FIG. 6) to display an operating state of the washing machine 100.

The detergent drawer 115 may be provided on the side of the control panel 114, and a detergent storage portion and a front exposed portion of the detergent drawer 115 may be integrally formed. The front exposed portion may be configured as a handle that allows a user to open and close the detergent drawer 115.

The cabinet 110 has a front portion, side portions, a rear portion, a top portion, and a bottom portion forming an exterior of the washing machine 100. A level sensor 430 may be provided at the center of the top portion of the cabinet 110.

The level sensor 430 is located at the center portion of the highest portion of the washing machine 100 so that the washing machine 100 may more accurately sense the degree of tilting. The level sensor 430 may be configured to measure a degree of tilting of the washing machine with respect to the direction of gravity, by a combination of an acceleration sensor, a gyro sensor, a geomagnetic sensor, and the like.

In addition to the level sensor 430, additional sensors may be disposed in the washing machine 100. These additional sensors may measure how much the washing machine 100 has rotated about an axis in the direction of gravity, so that the degree to which the washing machine is tilted is measured in a roll angle, a pitch angle, and a yaw angle.

Figure 5:
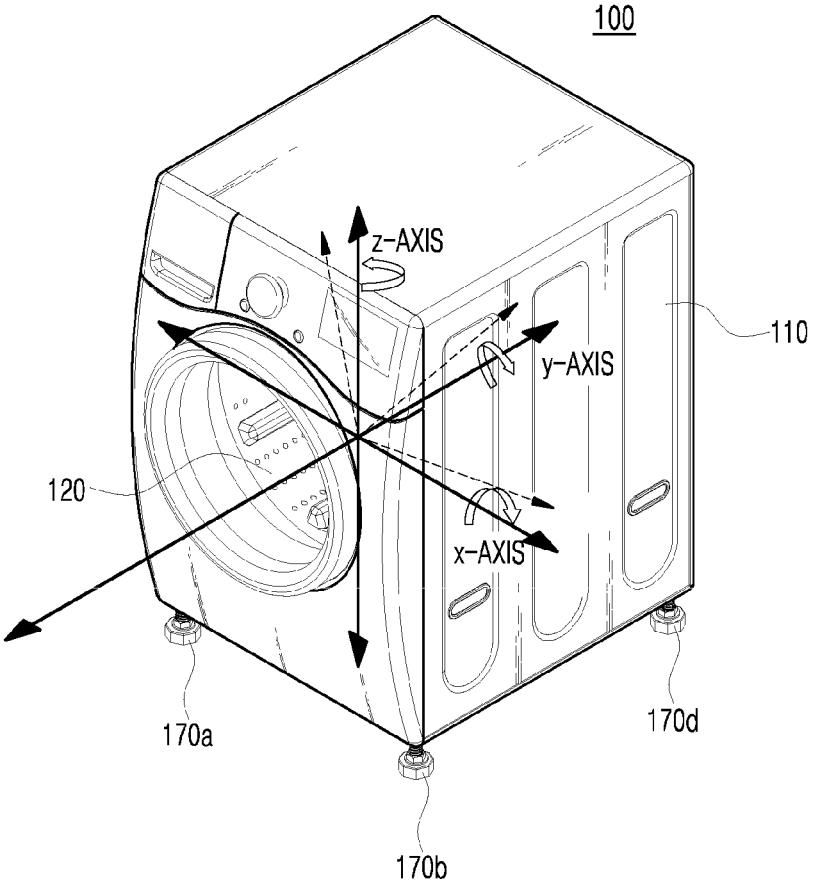
FIG. 5 is a view illustrating a basis for measuring a tilt of the washing machine according to an embodiment of the present disclosure.

Referring to FIG. 5, a basis for measuring a tilt of the washing machine 100 will be described. The z-axis is an axis in the gravity direction, and the x and y-axes are direction axes that offset each other by 90 degrees with respect to an azimuth angle. For example, the x-axis may represent east-west and the y-axis may represent north-south.

The angle that rotates about the x-axis is referred to as the roll angle, the angle that rotates about the y-axis is referred to as the pitch angle, and the angle that rotates about the z-axis is referred to as the yaw angle.

Here, an angle associated with vibration of the washing machine 100 will mainly be the roll angle and the pitch angle. When the washing machine 100 is located to be level with respect to the ground, even if the drum 120 rotates, hardly any vibration will be generated. However, when a vertical axis of the washing machine 100 is offset from the gravity axis (that is, when the vertical axis of the washing machine represented by the dotted line in FIG. 5 does not coincide with the z-axis), the washing machine 100 may be caused to vibrate by rotation of the drum 120.

However, even if the vertical axis of the washing machine 100 coincides with the gravity axis, there may be a case where the vibration may be generated due to uneven distribution of the laundry in the drum 120, or the like.

To start the washing, the user opens the door 113 to insert the laundry, and then closes the door 113 and puts detergent, fabric softener, and the like into the detergent drawer 115. Then, after the user sets washing options using a control panel 114 and confirms a washing mode and time on a display 141, the washing is started.

When a washing start button is pressed, the washing machine 100 uses a weight sensor or the like to determine an amount of water suitable for washing and a washing time according to a weight of laundry received in the drum 120 and an inputted washing option.

A water supply pipe 151 for supplying cold water and hot water is connected to the detergent drawer 115 to supply water. The supplied water is mixed with the detergent and the fabric softener and supplied to the tub 140.

The tub 140 configured to receive washing water is disposed to surround the drum 120, and is airtight so as to prevent the washing water from leaking. The drum 120 has a plurality of through holes to allow the washing water to be supplied from the tub 140 to the drum 120. When a spin-dry operation, among operation options of the washing machine 100, proceeds, the washing water may be discharged to the outside from the drum 120 through the through holes.

When the washing water flows into the tub 140, the washing water is also introduced the drum through the through holes of the drum 120. After the washing water is filled to a certain extent, the drum 120 is rotated.

The drum 120 is rotatably disposed in the tub 140 and connected to a driving shaft 131 of a motor 130. The motor 130 is powered, and the motor 130 rotates the drive shaft 131 when the rotation operation starts. The driving shaft 131 is fixed through the tub 140 to the rear surface of the drum 120, and rotates the drum 120 about the driving shaft 131.

In the drum 120, a plurality of lifters 121 may be installed, wherein the lifters are configured to allow laundry to be caught on the lifters and rotated together with the drum 120. The laundry is caught by the lifter 121 and rotates together with the drum 120, and when the laundry is unevenly distributed and caught on a specific lifter 121, the drum 120 may vibrate.

Figure 6:
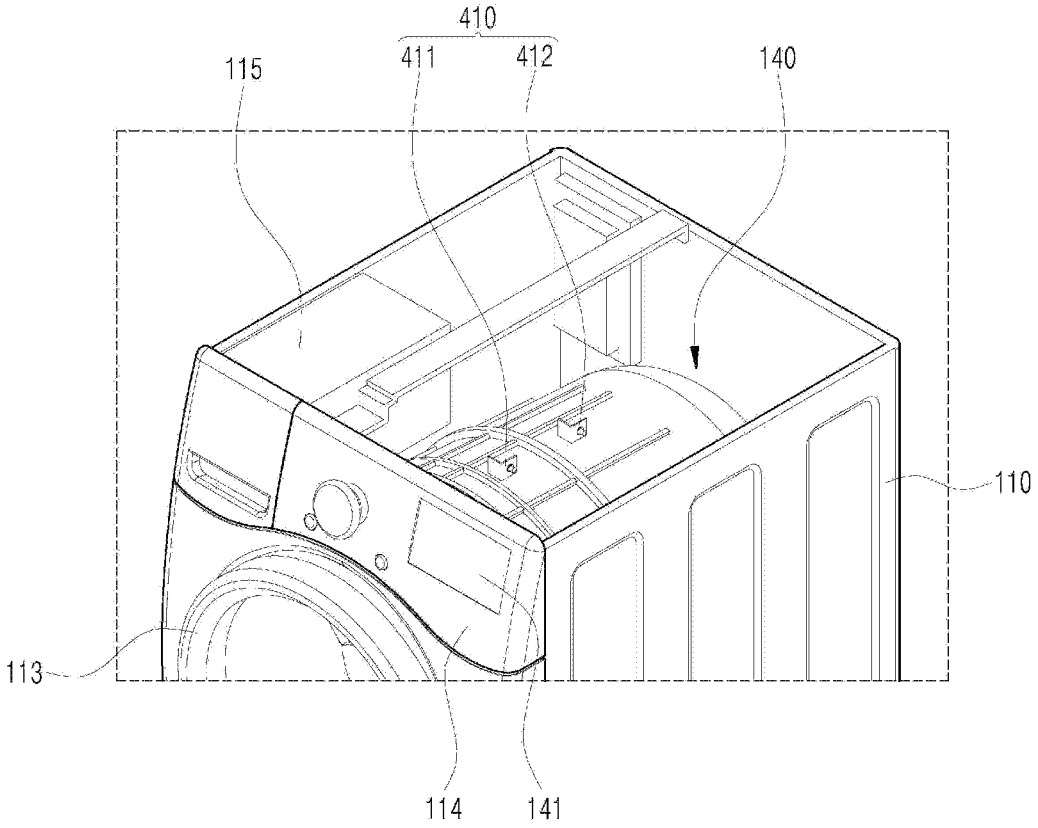
FIG. 6 is a view showing an interior of a top portion of the washing machine according to an embodiment of the present disclosure.

FIG. 6 is a view showing an interior of a top portion of the washing machine according to an embodiment of the present disclosure.

As shown in FIG. 6, a vibration sensor 410 is disposed on an outer surface of the tub 140. The vibration sensor 410 is configured to measure vibration of the tub 140 generated when the washing machine 100 operates. An acceleration sensor or an optical sensor used for measuring the vibration may be employed as the vibration sensor 410. The vibration sensor 410 may sense specific information on the vibration generated by rotation of the drum 120, such as a vibration direction, a vibration amplitude, a vibration frequency, or the like. In the following description, a vibration magnitude refers to the vibration frequency or the vibration amplitude.

The vibration sensor 410 may include a first vibration sensor 411 and a second vibration sensor 422. The first vibration sensor 411 may be disposed in the front of the tub 140 to measure the vibration generated in the front half of the tub 140. The second vibration sensor 422 may be disposed in the rear of the tub 140 to measure the vibration generated in the rear half of the tub 140.

In FIG. 6, although only two vibration sensors are disposed, more vibration sensors may be mounted along a circumference of the tub 140 to obtain more precise vibration information.

In most cases, the vibration generated by rotation of the drum 120 is generated in a direction perpendicular to the rotation axis, rather than in the rotation axis direction. Therefore, it may be more effective for the vibration sensor to be disposed at a location of one surface of the tub at which the vibration in the direction perpendicular to the rotation axis of the drum may be sensed.

In addition, the vibration sensor may be disposed at other locations of the washing machine 100, and not the tub 140. For example, if the influence of the vibration generated by rotation of the drum 120 on the cabinet 110 is desired to be known, the vibration sensor may be disposed on the cabinet 110.

Figure 7:
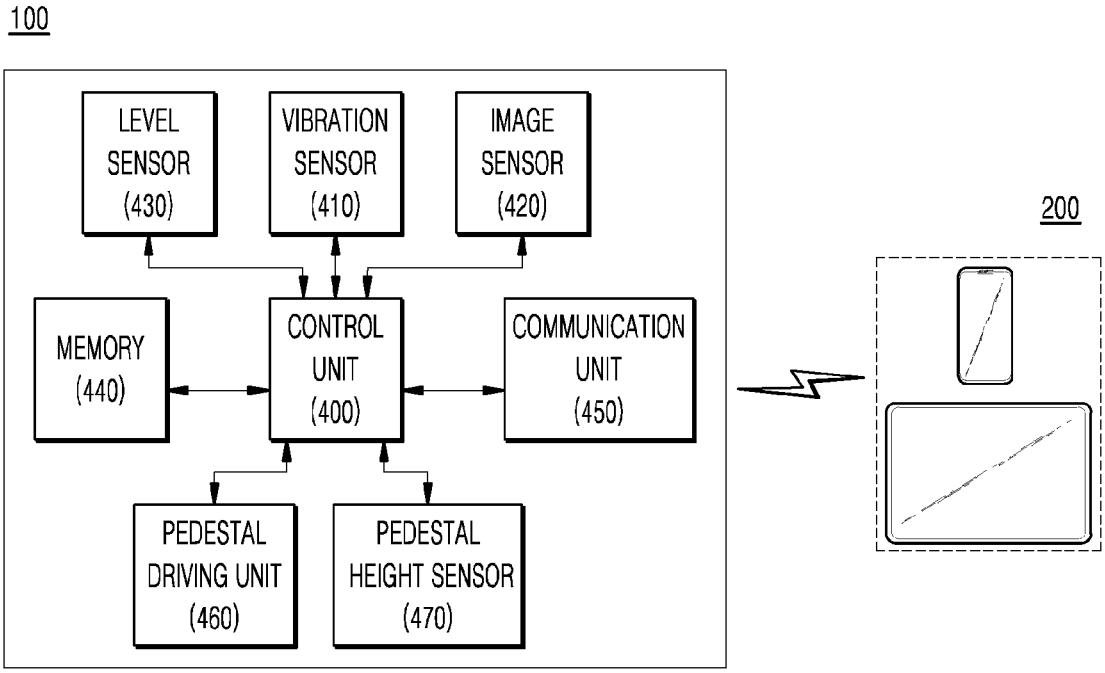
FIG. 7 is a block diagram illustrating a washing machine and a user terminal communicating with the washing machine according to another embodiment of the present disclosure.

FIG. 7 is a block diagram illustrating a washing machine and a user terminal communicating with the washing machine according to another embodiment of the present disclosure.

The washing machine 100 may include a vibration sensor 410 configured to sense vibration of the washing machine 100; an image sensor 420 configured to determine an amount and a position of laundry; a level sensor 430 configured to measure a tilt of the washing machine 100; a memory 440 in which operating options of the washing machine 100, information on a vibration frequency of the washing machine 100 according to the tilt of the washing machine 10 and other information are stored; a communication unit 450 configured to communicate with a user terminal or a server; a pedestal driving unit 460 configured to adjust a height and a tilt of the washing machine 100; a pedestal height sensor 470 configured to sense the height of a pedestal or support of the washing machine 100; and a control unit 400 configured to communicate with and control them.

The memory 440 may store information for leveling of the washing machine. Here, the information for leveling is information that is learned in a leveling learning mode, wherein the leveling learning mode is a mode for learning the leveling which is activated before the washing machine is actually used, or is activated while the washing machine is actually used. More specifically, the information for leveling is information that is learned, in the leveling learning mode, by sensing the vibration generated while adjusting the tilt of the cabinet 110, under various conditions for at least one of a rotational speed of the drum 120 and a weight of laundry received in the drum 120, and is information on a tilt value of the cabinet 110 that is capable of minimizing the vibration in each of the conditions.

That is, in the leveling learning mode of the washing machine 100, the washing machine 100 senses, by means of the vibration sensor 410, the vibration generated while varying the tilt of the cabinet 110 while the drum 120 is rotating, and records, in the memory 440, the tilt value when the smallest vibration is sensed. Further, after detecting the tilt value that is capable of minimizing the vibration in one condition, the washing machine 100 detects the tilt value that is capable of minimizing the vibration for each rotational speed of the drum 120 while varying the rotational speed of the drum 120, and records the tilt values in the memory 440.

Thereafter, when a different weight of laundry is received in the drum, the washing machine 100 may repeat the same process as above. Accordingly, the washing machine 100 may detect the tilt value of the cabinet 110 that is capable of minimizing the vibration for each condition under which the rotational speed of the drum 120 and the weight of laundry received in the drum 120 vary, and may record the tilt values in the memory 440.

That is, the leveling information of the memory 440 may store information on the tilt value of the cabinet 110 and the vibration frequency at that tilt value, for each of the rotational speed of the drum 120 and the weight of laundry, and information on a tilt value that is capable of minimizing the vibration frequency.

This leveling learning mode may be set to be performed at the factory before the washing machine 100 is shipped. Also, the leveling learning mode may be set to be performed for an initial period of time after the washing machine 100 is installed at the place of use.

The vibration sensor 410 may be disposed in a manner as shown in FIG. 6 to sense the vibration generated by rotation of the drum 120. The processor or control unit 400 of the washing machine 100 may receive a vibration value; receive tilt information on the cabinet 110 from the level sensor 430 when a vibration magnitude is greater than a predetermined threshold; receive, from the vibration sensor 410, information on the vibration generated by rotation of the drum 120; and analyze a vibration direction, a vibration amplitude, and a vibration frequency to derive the tilt value of the cabinet 110 that is capable of minimizing the vibration.

When the washing machine 100 has a structure capable of adjusting the height of the height adjustable support 170 or the height of the pedestal, the control unit 400 of the washing machine may monitor, in real time, the vibration value sensed by means of the vibration sensor 440 while varying the height of the support 170. By doing so, the control unit 400 may derive height information of the support 170, that is, the tilt value of the cabinet 110 that is capable of minimizing the vibration value.

Alternatively, the control unit 400 of the washing machine 100 may derive the tilt value that is capable of minimizing the vibration according to the rotational speed of corresponding drum 120 and the weight of laundry received in the drum 120, based on the leveling information stored in the memory 440.

The control unit 400 may transmit, by means of the communication unit 450, the derived tilt value or the height information of the support for achieving corresponding tilt value, to the user terminal 200. The user may read the received height information for the support, and manually adjust the height of the support of the washing machine 100.

When the washing machine 100 has a structure capable of adjusting the height of the height adjustable support 170 or the height of the pedestal, the control unit 400 may adjust the height of the pedestal using a pedestal drive portion 460 and a pedestal height sensor 470 to achieve the derived tilt value.

Even if the derived tilt value is initially achieved, there may still be a case where the vibration is generated. In this case, when the vibration magnitude is equal to or greater than a predetermined value, the control unit 400 receives vibration information from the vibration sensor 410, and searches for an optimal tilt value that minimizes the vibration magnitude, while causing the pedestal drive portion 460 to vary the tilt of the cabinet 110 within a certain range from the achieved tilt value.

The control unit 400 may re-adjust the height of the pedestal using the pedestal height sensor 470 and the pedestal drive portion 460 so that the searched optimal tilt value is achieved. Accordingly, the tilt value of the cabinet 110, that is, the height of the pedestal that is capable of minimizing the vibration, can be more accurately achieved.

Figure 8:
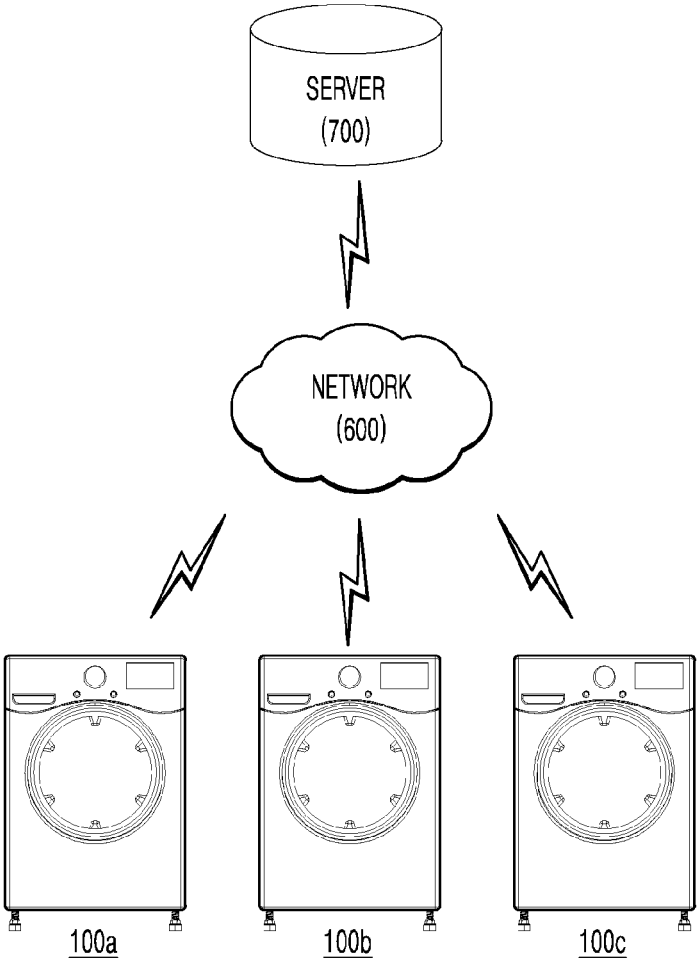
FIG. 8 is a view illustrating a linkage system of washing machines according to still another embodiment of the present disclosure.

FIG. 8 is a view illustrating a linkage system of washing machines according to another embodiment of the present disclosure.

In FIG. 8, a plurality of washing machines 100*a*, 100*b*, and 100*c* are connected to the server 700 via the network 600. Each of the washing machines may monitor changes in the vibration generated while adjusting a tilt of the washing machine, under specific conditions for a rotational speed of the drum 120 and a weight of laundry received in the drum 120, in the leveling learning mode. By doing so, each of the washing machines may detect a tilt value of the washing machine that is capable of minimizing a vibration magnitude.

Further, each of the washing machines may transmit, via the network 600, the tilt value of the washing machine 100 that is capable of minimizing the vibration magnitude, to the server 700. The transmitted information is accumulated, so that a database of tilt values that are capable of minimizing the vibration under the conditions for the various models of washing machines may be created in the server 700.

Each of the washing machines may be connected to the database when the vibration is equal to or greater than a threshold in a later operating mode, and may receive information on the tilt value that the corresponding model has to achieve in order to have a minimum vibration in the corresponding condition.

In addition, as described above, when the optimal tilt value is detected after the tilt is initially achieved, the washing machine 100 may upload information for the detected optimal tilt value to the server 700 again. By doing so, the information for leveling may be continuously updated in the database of the server 700.

Figure 9:
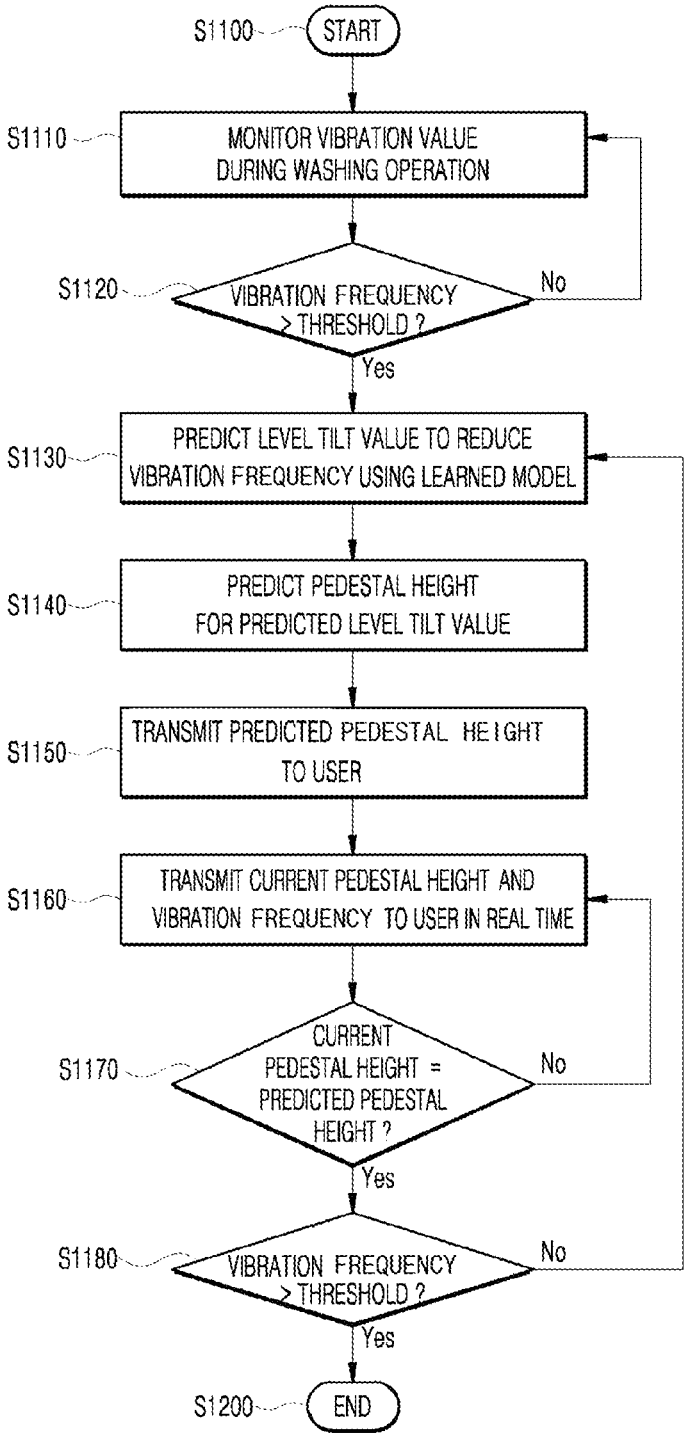
FIG. 9 is a flowchart of a method for adjusting a level of a washing machine according to an embodiment of the present disclosure.

FIG. 9 is a flowchart of a method for adjusting a level of a washing machine according to an embodiment of the present disclosure.

The flowchart of FIG. 9 illustrates an embodiment in which heights of pedestals are not adjusted by the washing machine 100 itself, but are adjusted manually by a user.

When washing is started, the control unit 400 of the washing machine monitors a vibration value collected by the vibration sensor 410, at S1110. During monitoring, it is determined whether a vibration magnitude, for example, a vibration frequency, exceeds a predetermined threshold, at S1120. If so, as described above, the tilt value of the cabinet 110 that is capable of minimizing the vibration frequency may be predicted using a model previously learned in the leveling learning mode, at S1130.

That is, when there is a condition corresponding to a current washing condition in a leveling information database stored in the memory 440, the tilt value of the cabinet 110 that is capable of minimizing the vibration frequency is searched and derived.

Here, a tilt adjustment process of the cabinet 110 is started based on whether the vibration frequency exceeds the predetermined threshold. However, the tilt adjustment process may be started based on whether a vibration amplitude exceeds the predetermined threshold. In addition, irrespective of the vibration magnitude to be sensed, the tilt adjustment process of the cabinet 110 may be started when a washing stage, such as a spin-dry stage which is expected to increase the vibration by rotation, is started.

Subsequently, the control unit 400 predicts how much the heights of the pedestals supporting the cabinet 110 should be adjusted, in order to tilt the cabinet 110 to achieve the derived tilt value, at S1140.

The communication unit 450 transmits information on the predicted heights of the pedestals to a user terminal so that the user is capable of recognizing corresponding information, at S1150. The user may recognize, though the user terminal, that vibration of a current washing machine 100 is excessive, and may read information on the heights of pedestals to be adjusted in order to reduce the vibration.

The user may adjust the heights of the pedestals according to the received information, and the communication unit 450 may transmit, in real time, current heights of the pedestals and the vibration frequency, to the user terminal, at S1160. The user may adjust the heights of the pedestals while checking the height information of the pedestals received in real time, though the user terminal, in order to achieve targeted heights of the pedestals.

The control unit 400 senses the heights of the pedestals by means of the pedestal height sensor 470, and determines whether the adjusted heights of the pedestals have reached the predicted heights of the pedestals, at S1170. When the adjusted heights of the pedestals have reached the predicted heights of the pedestals, a notification signal may be transmitted to the user terminal.

Thereafter, the control unit 400 determines whether the vibration frequency of the washing machine 100 has decreased to less than or equal to the predetermined threshold, in order to determine whether the vibration frequency has been reduced by adjusting the heights of pedestals, at S1180.

When the vibration frequency exceeds the threshold, the tilt adjustment process may be resumed. If it is determined that the vibration frequency is less than the threshold, adjustments for the tilt of the washing machine 100 and the heights of the pedestals are ended, at S1200.

Figure 10:
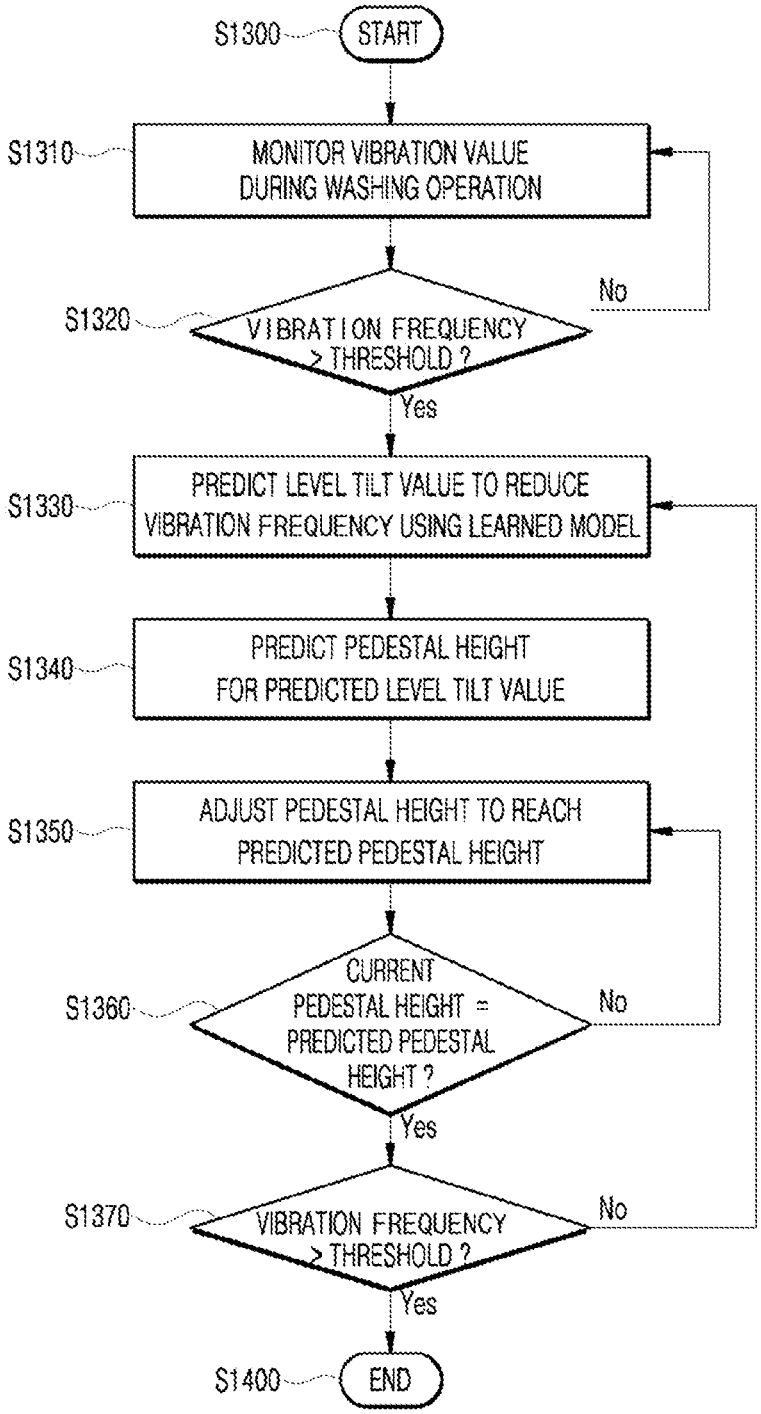
FIG. 10 is a flowchart of a method for adjusting a level of a washing machine according to another embodiment of the present disclosure.

FIG. 10 is a flowchart of a method for adjusting a level of a washing machine according to another embodiment of the present disclosure.

The flowchart of FIG. 10 illustrates an embodiment in which heights of pedestals may be adjusted by the washing machine 100 itself, using a pedestal driving unit 460.

When washing is started, the control unit 400 of the washing machine monitors a vibration value collected by the vibration sensor 410, at S1310. During monitoring, it is determined whether a vibration magnitude, for example, a vibration frequency, exceeds a predetermined threshold, at S1320. If so, as described above, the tilt value of the cabinet 110 that is capable of minimizing the vibration frequency may be predicted using a model previously learned in the leveling learning mode, at S1330.

Here, the prediction of the tilt value may include searching and deriving a tilt value of the cabinet 110 that is capable of minimizing the vibration frequency when there is a condition corresponding to a current washing condition in a leveling information database stored in the memory 440.

Subsequently, the control unit 400 predicts how much the heights of the pedestals supporting the cabinet 110 should be adjusted, in order to tilt the cabinet 110 to achieve the derived tilt value, at S1340.

The control unit 400 adjusts the heights of the pedestals using the pedestal driving unit 460, so that the predicted heights of the pedestals are achieved, at S1350. The communication unit 450 may transmit, in real time, current heights of the pedestals and the vibration frequency to the user terminal to allow the user to monitor the tilt adjustment process.

If the heights of the pedestals of the washing machine 100 are adjusted to targeted heights of the pedestals, at S3160, it is again determined whether the vibration frequency has been reduced to less than or equal to a predetermined threshold, at S1370.

When the vibration frequency exceeds the threshold, the tilt adjustment process may be resumed. If it is determined that the vibration frequency is less than the threshold, adjustments for the tilt of the washing machine 100 and the heights of the pedestals are ended, at S1400.

After a target tilt value is initially achieved, a process may be added to search for whether there is a tilt condition that may ensure a lower frequency of vibration within a section adjacent to corresponding tilt, in order to more precisely reduce the vibration frequency.

In this process, the tilt of the cabinet 110 may be varied while adjusting the heights of the pedestals within a certain range from the target tilt value achieved initially, and vibration information may be received from the vibration sensor 410 to thereby search for an optimal tilt value that minimizes a vibration magnitude. Thereafter, the heights of the pedestals may be re-adjusted to achieve the searched optimal tilt value.

Although the washing machine has been exemplified in the above description, it will be easily understood that ideas of the present disclosure described above may be applied to any apparatus in which rotation of the rotating member may cause vibration.

Additionally, in another embodiment of the present disclosure, the apparatus of the present disclosure may be implemented as a computer-readable storage medium having at least one program recorded thereon. The at least one program is configured to, when executed by the apparatus, cause the apparatus to perform the method for adjusting the level according to the above-described embodiments of the present disclosure.

Further, although all components of embodiments of the present disclosure may have been explained as being integrally coupled or operatively coupled as a unit, but present disclosure is not necessarily limited to such embodiments. Alternatively, within the scope of the present disclosure, the respective components may be selectively coupled and operated in any numbers. In addition, although every one of the components may be also implemented in single independent hardware, the respective components may be combined in part or as a whole selectively and implemented as a computer program having program modules for executing some or all of combined functions in one or a plurality of hardware. Codes or code segments to constitute the computer program may be easily deduced by a person skilled in the art. The computer program may is stored in computer readable media, which is readable and executed by a computer, in order to realize the embodiments of the present disclosure. The storage medium of the computer program may include a magnetic recording medium, an optical recording medium, and a storage medium including a semiconductor recording device. Also, the computer program embodying the present disclosure may include a program module that is transmitted in real time via an external apparatus.

While the foregoing has been described focusing on embodiments of the present disclosure, various changes and modifications may be made by those skilled in the art. Therefore, it is to be understood that such changes and modifications are intended to be included within the scope of the present disclosure without departing from the scope of the present disclosure.

The invention claimed is:

1. A method for adjusting a level of an apparatus, wherein the apparatus comprises: a cabinet having a front portion, a rear portion, side portions, a top portion, and a bottom portion forming an exterior of the apparatus; a rotating member disposed in the cabinet; a weight sensor configured to sense a weight of a laundry received in the rotating member; a level sensor configured to sense a tilt of the cabinet; a vibration sensor configured to sense vibration generated by rotation of the rotating member; a plurality of height adjustable supports disposed on the bottom portion of the cabinet; and a processor configured to communicate with the level sensor and the vibration sensor, the method comprising:

sensing, by means of the vibration sensor, the vibration generated by rotation of the rotating member; and deriving, by means of the processor, a target tilt value of the cabinet that is capable of minimizing the vibration according to the weight of the laundry and a rotational speed of the rotating member, based on a previously learned leveling model, when a vibration magnitude exceeds a predetermined threshold, wherein the previously learned leveling model is a learning model which is learned in a leveling learning mode of the apparatus by sensing the vibration generated while adjusting the tilt of the cabinet, under various conditions for the rotational speed of the rotating member and the weight of the laundry received in the rotating member, and is trained to predict a tilt value of the cabinet that is capable of minimizing the vibration in each of the conditions, wherein the method for adjusting the level of the apparatus further comprises:

in the leveling learning mode of the apparatus, sensing and analyzing vibration generated while adjusting the tilt of the cabinet, under various conditions for the rotational speed of the rotating member disposed in the apparatus and the weight of the laundry received in the rotating member; and obtaining information on the tilt value of the cabinet that is capable of minimizing the vibration, in each of the conditions in the sensing and analyzing and storing the obtained information as a leveling model of the apparatus.

2. The method of claim 1, further comprising:

after the deriving the target tilt value, transmitting, by means of a communication unit disposed in the apparatus, heights of the supports to be adjusted in order to achieve the tilt value of the cabinet that is capable of minimizing the vibration, to a user terminal.

3. The method of claim 2, further comprising:

after the transmitting, measuring a vibration value and determining whether the vibration value is less than or equal to a predetermined threshold, by means of the vibration sensor, when the tilt value of the cabinet is achieved; and re-deriving, by means of the processor of the apparatus, the tilt value of the cabinet that is capable of minimizing the vibration value, based on the leveling model, when the vibration value exceeds the predetermined threshold.

4. The method of claim 1, wherein the apparatus further comprises a controller configured to adjust heights of the supports, and the method further comprises, after the deriving the target tilt value, adjusting, by means of the controller, the heights of the supports in order to achieve the target tilt value of the cabinet that is capable of minimizing the vibration.

5. The method of claim 4, further comprising:

after the adjusting the heights of the supports, receiving vibration information from the vibration sensor and searching for an optimum tilt value that minimizes the vibration magnitude, by means of the controller, while varying the tilt of the cabinet within a certain range from the achieved tilt value in the adjusting the heights of the supports; and re-adjusting, by means of the controller, the heights of the supports to achieve the searched optimal tilt value.

6. The method of claim 5, further comprising, after the re-adjusting, updating the leveling model using the searched optimal tilt value.

* * * * *